United States Patent [19]

Casey et al.

[11] Patent Number: 4,647,928

[45] Date of Patent: Mar. 3, 1987

[54] STABILITY INDICATOR FOR MARINE VESSEL

[75] Inventors: Thomas A. Casey; Miles L. Rice, both of Kirkland; William B. Keough, Seattle; Dan E. Rothenbuhler, Acme; Bruce E. Trimble, Seattle, all of Wash.

[73] Assignee: Marine Partners, Seattle, Wash.

[21] Appl. No.: 577,493

[22] Filed: Feb. 6, 1984

[51] Int. Cl.[4] ..... G08B 23/00; B63B 39/00

[52] U.S. Cl. ..... 340/98.4; 73/65; 114/122; 364/463

[58] Field of Search ..... 340/984, 689; 364/463, 364/434; 235/61 T; 73/65, 181, 178 R; 114/121, 122; 318/585

[56] References Cited

U.S. PATENT DOCUMENTS

| | | | |
|---|---|---|---|
| 1,860,345 | 5/1932 | Wilson | 73/65 |
| 2,341,563 | 2/1944 | Kreitner et al. | 73/65 |
| 2,492,178 | 12/1949 | Perkins et al. | 73/65 |
| 3,329,808 | 7/1967 | Fisher | 235/193 |
| 3,351,275 | 11/1967 | Jablonski | 235/61 |
| 3,421,060 | 1/1969 | Irvine | 114/122 |
| 3,727,572 | 4/1973 | Nelson et al. | 114/122 |
| 3,847,348 | 11/1974 | Russ | 235/151.3 |
| 3,917,937 | 11/1975 | Sten | 235/193 |
| 3,928,754 | 12/1975 | Edlund | 364/434 |
| 3,982,424 | 9/1976 | Peach | 73/65 |
| 4,388,889 | 6/1983 | Baitis et al. | 114/122 |

OTHER PUBLICATIONS

Bell, 'Stabilizing the Queen Mary', 3–59.
Ocean Motions Company document, Jan. 1983.

*Primary Examiner*—James L. Rowland
*Assistant Examiner*—Brent A. Swarthout
*Attorney, Agent, or Firm*—Christensen, O'Connor, Johnson & Kindness

[57] ABSTRACT

A stability indicator for a marine vessel. The indicator continuously determines a GM value for the vessel equal to the square of the vessel's beam length times the square of the vessel's rolling constant divided by the square of the vessel's rolling period. The rolling period is determined by means of a gravity sensor whose output is an electrical signal corresponding to the instantaneous magnitude and direction of the roll angle. Electronic level adjustment and gain selection means are also provided, to compensate for the fact that the stability indicator may often be installed with the gravity sensor off-horizontal. The signal from the gravity sensor is input into a data processor that computes the rolling period by first analyzing the roll angle signal to establish a zero level and threshold levels above and below the zero level. The rolling period is then determined to be the time required for the roll angle to change from the positive threshold, to a value less than the negative threshold, and back to the positive threshold again. Successive rolling periods are averaged by means of a recursive filter, and the average rolling period is used to determine GM. In another embodiment of the present invention, the stability indicator includes means for calculating two average rolling periods. The first average rolling period is determined by averaging a fixed number of successive rolling periods, and the second average rolling period is determined by averaging a selectable number of successive rolling periods. First and second GM values are calculated based on the first and second average rolling periods respectively. Means are also included for providing a warning when the first GM value is less than an alarm level, and for displaying the second GM value.

15 Claims, 11 Drawing Figures

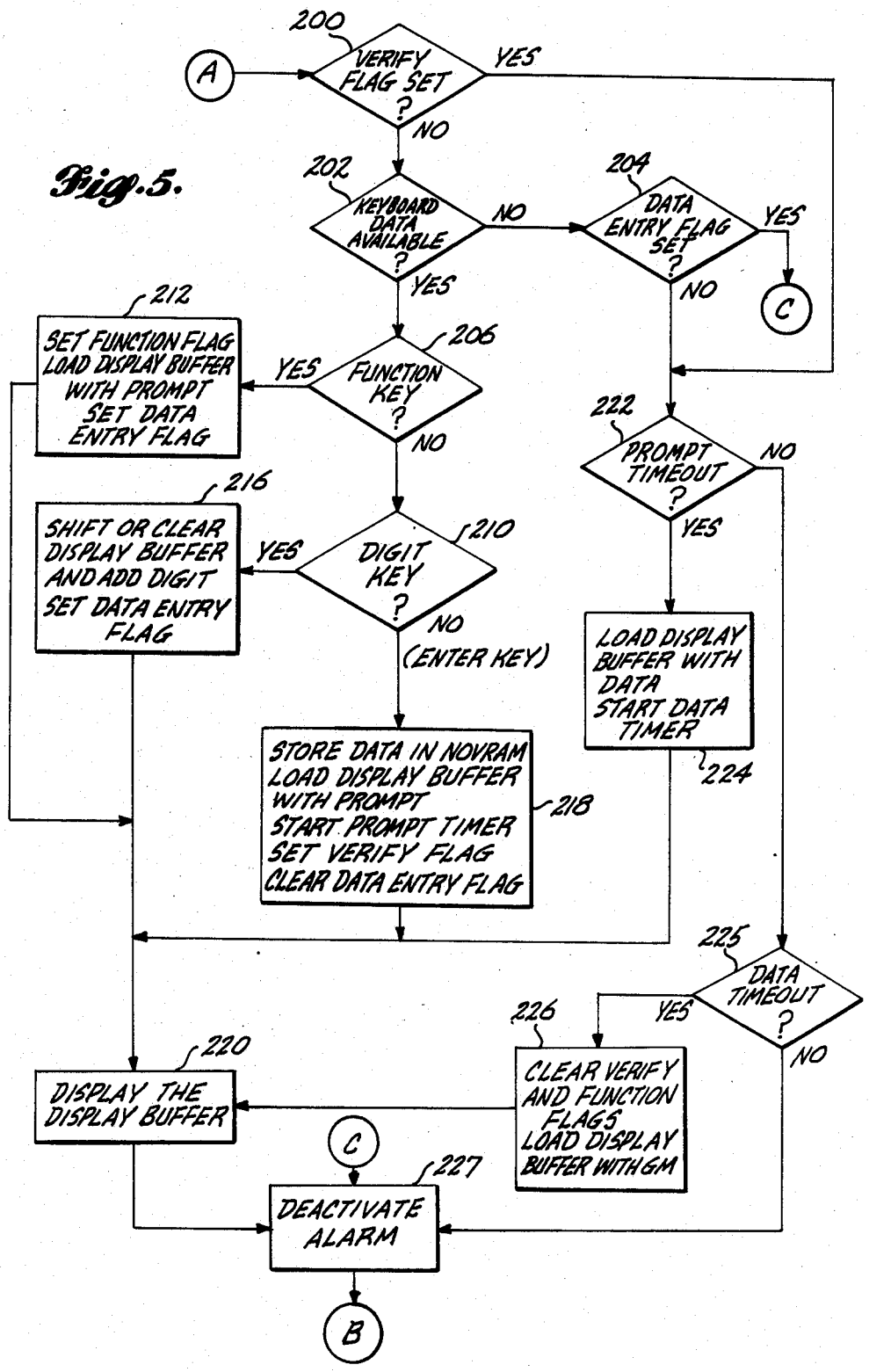
Fig.5.
A
200
VERIFY FLAG SET ?
YES
NO
202
KEYBOARD DATA AVAILABLE ?
NO
YES
204
DATA ENTRY FLAG SET ?
YES
NO
C
212
SET FUNCTION FLAG
LOAD DISPLAY BUFFER WITH PROMPT
SET DATA ENTRY FLAG
206
FUNCTION KEY ?
YES
NO
222
PROMPT TIMEOUT ?
NO
YES
216
SHIFT OR CLEAR DISPLAY BUFFER AND ADD DIGIT
SET DATA ENTRY FLAG
210
DIGIT KEY ?
YES
NO
(ENTER KEY)
LOAD DISPLAY BUFFER WITH DATA
START DATA TIMER
224
STORE DATA IN NOVRAM
LOAD DISPLAY BUFFER WITH PROMPT
START PROMPT TIMER
SET VERIFY FLAG
CLEAR DATA ENTRY FLAG
218
225
DATA TIMEOUT ?
YES
NO
226
CLEAR VERIFY AND FUNCTION FLAGS
LOAD DISPLAY BUFFER WITH GM
220
DISPLAY THE DISPLAY BUFFER
C
227
DEACTIVATE ALARM
B

STABILITY INDICATOR FOR MARINE VESSEL

BACKGROUND OF THE INVENTION

Marine capsizings are one of the major causes of loss of life and property at sea. Capsizing occurs when a boat loses stability, i.e., when it loses the ability to right itself after it has been to one side by the forces of wind or water. An accepted measure of a vessel's stability is its GM value, defined as the distance between the vessel's transverse metacenter and its center of gravity. The transverse metacenter of a ship can be thought of as the maximum height to which the center of gravity can rise before the ship loses its initial stability. The position of a ship's center of gravity depends upon a number of time varying factors such as cargo loading, movement or shifting of cargo, fuel consumption, icing, and absorption of water by deck cargo. As the position of center of gravity changes, so does the vessel's GM value and its stability. If the center of gravity rises to a point above the transverse metacenter, GM becomes negative and the ship will not return to even keel and is in danger of capsizing.

When a vessel's transverse metacenter is known, it is possible to compute GM by careful consideration of the weight and distribution of fuel and cargo. Analog and digital computing devices have been developed in an effort to automate such a calculation. While of considerable value, static calculations of this kind do not take into account factors such as icing and shifting of cargo which can rapidly change GM and threaten the vessel's stability.

An instrument capable of continuously monitoring GM is described in U.S. Pat. No. 1,860,345. The apparatus shown in that patent determines GM from a vessel's maximum roll angle in conjunction with its maximum rate of roll. The former is measured by a pendulum, and the latter by determining the maximum force on the bearings of a gyroscope. The device is mechanically quite complex, and would require careful calibration to perform properly. Furthermore, the technique disclosed in that patent requires knowledge of the radius of gyration, a quantity not readily available for many vessels.

SUMMARY OF THE INVENTION

The present invention provides a stability indicator for continuously and reliably monitoring the stability of a marine vessel. In one preferred embodiment, the indicator computes the current GM value based on the equation:

$$GM=(BR/T)^2$$

where B is the vessel's beam, R is its rolling constant, and T is its average full rolling period. By basing the GM calculation on an electronically determined time interval, the present invention provides the accuracy and reliability lacking in most prior devices. Furthermore, the beam and rolling constant are readily available parameters for most vessels, and the stability meter of the present invention can therefore be installed and calibrated with a minimum of effort.

In another preferred embodiment, the time required for the vessel to complete a roll is determined by means of a gravity sensor whose ouput is an electrical signal corresponding to the instantaneous magnitude and direction of the roll angle. Electronic level adjustment and gain selection means are also provided, to compensate for the fact that the stability indicator may often be installed with the gravity sensor off-horizontal. The signal from the gravity sensor is input into a data processor that computes the rolling period by first analyzing the roll angle signal to establish a zero level and threshold levels above and below the zero level. The rolling period is then determined to be the time required for the roll angle to change from the positive threshold, to a value less than the negative threshold, and back to the positive threshold again. Successive rolling periods are averaged by means of a recursive filter, and the average rolling period is used to determine GM.

In another embodiment of the present invention, the stability indicator includes means for calculating two average rolling periods. The first average rolling period is determined by averaging a fixed number of successive full rolling periods, and the second average rolling period is determined by averaging a selectable number of successive rolling periods. First and second GM values are calculated based on the first and second average rolling periods respectively. Means are also included for providing a warning when the first GM value is less than an alarm level, and for displaying the second GM value.

These and other features and advantages of the invention will become apparent in the detailed description and claims to follow taken in conjunction with the accompanying drawings.

BRIEF DESCRIPTION OF THE DRAWINGS

FIG. 5 is a flow diagram of a portion of a program for operating the microprocessor of the present invention;

DETAILED DESCRIPTION OF THE INVENTION

The stability indicator of the present invention is intended for mounting in the pilothouse or at any other appropriate location in a marine vessel. In one preferred embodiment, the indicator continuously displays the vessel's GM value, calculated according to the equation $$GM=(BR/T)^2 \quad (1)$$

where B is the vessel's beam, R is the vessel's rolling constant, and T is an average value for the vessel's rolling period. The beam and rolling constant values are entered into the stability indicator in an initial calibration step. The rolling period is continuously measured by means of a gravity sensor responsive to the transverse rolling motion of the vessel. Successive rolling period values are averaged to produce the averaged rolling period T. A warning alarm is sounded if and when GM falls below a selectable alarm level.

Values for the beam and rolling constant for a ship are generally set forth in its Stability Letter, and are therefore readily determined for most commercial vessels. The installation and calibration of the present stability indicator can therefore be accomplished with a minimum of effort, and without resorting to time-consuming measurements and testing procedures.

Figure 1:
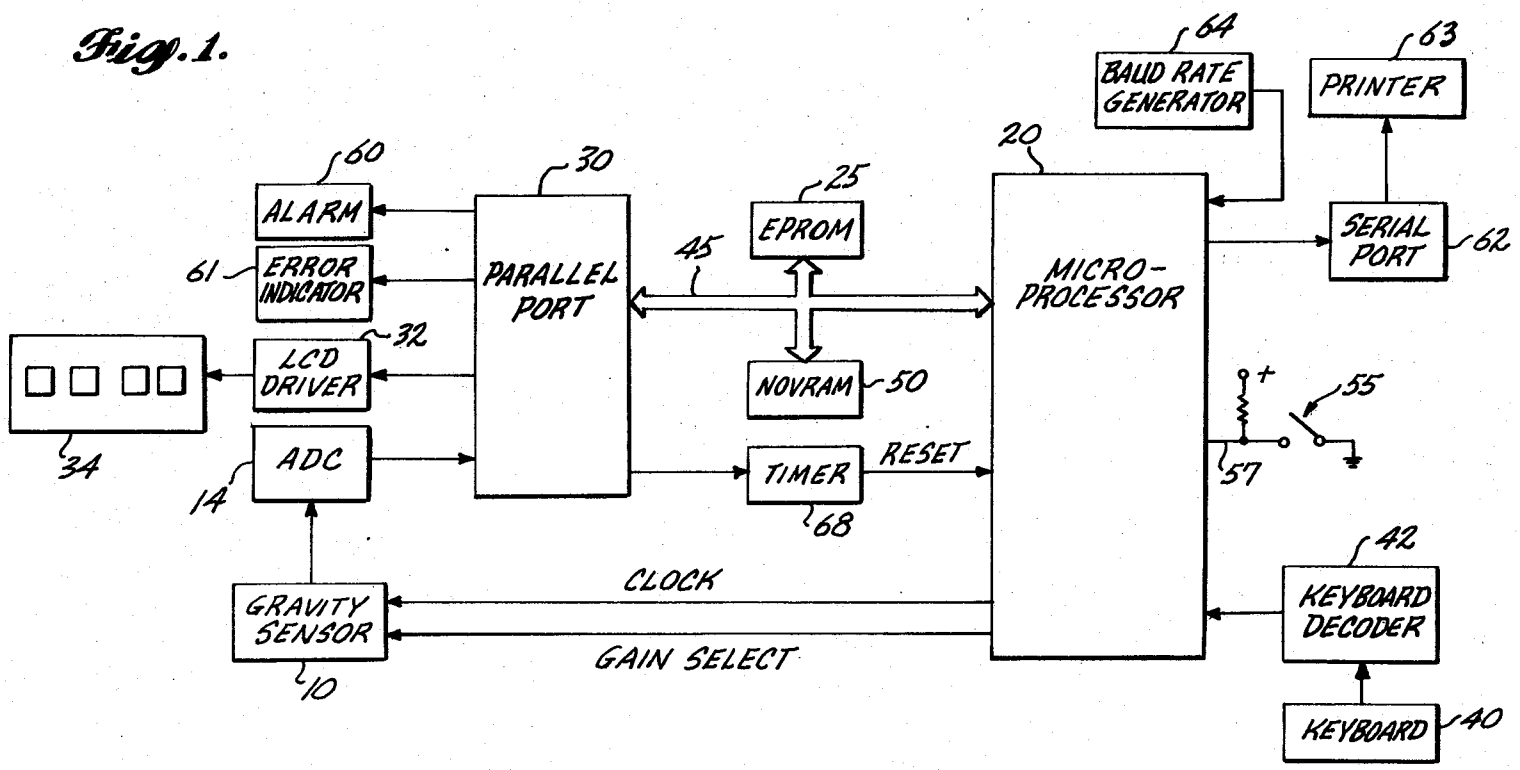
FIG. 1 is a block diagram of the stability indicator of the present invention.

A block diagram of a preferred embodiment of the present invention is set forth in FIG. 1. In this embodiment, gravity sensor 10 produces an analog signal indicative of the magnitude and direction of the instantaneous roll angle of the vessel. This analog signal is converted into a digital signal by analog-to-digital converter (ADC) 14, and the resulting digital signal is periodically sampled by microprocessor 20 through parallel port 30. The microprocessor, operating under the control of a program stored in EPROM 25, continuously calculates GM based on equation (1) above. The resulting GM value is displayed via parallel port 30, LCD drive 32, and LCD display unit 34. Beam, rolling constant, alarm level, and other parameters are entered into the stability indicator through keyboard 40 and keyboard decoder 42, and such values are stored in nonvolatile, random-access memory (NOVRAM) 50. Alarm 60 is activated if GM falls below a selectable alarm level. Alarm 60 may include an internal sound transducer such as a buzzer, or a set of relay contacts for connection to an external (e.g., ship-wide) alarm system, or preferably both. Error indicator 61 is used to indicate that forced or otherwise questionable rolling period values have been measured, and that the currently displayed GM value may therefore be incorrect. Timer 68 is a conventional watchdog timer that may be used to reset the microprocessor if events do not occur within prescribed time periods. A system bus 45 connects the microprocessor to NOVRAM 50, EPROM 25, and parallel port 30.

The stability indicator may also include a printer 63 and associated serial port 62 and baud rate generator 64. The printer can be used to provide a continuous and permanent record of GM over a period of time, so that potential problems with a ship's stability can be identified before they reach the danger point.

The stability indicator of FIG. 1 is housed in a unit or cabinet that is rigidly mounted in the vessel. Gravity sensor 10 is rigidly mounted within the unit, and as a result, the analog signal produced by gravity sensor 10 corresponds to the instantaneous roll angle of the vessel. Ideally, the mounting of the stability indicator would be such that gravity sensor 10 is horizontal with respect to the vessel, so that a "level" signal from the gravity sensor would correspond to zero vessel roll angle. In practice, it is difficult to eliminate small deviations from the horizontal when mounting an instrument in a ship, and the present invention therefore includes means, described below, for accurately determining the rolling period despite such deviations. The means for mounting gravity sensor 10 within its housing unit may include mechanical means for adjusting inclination of the sensor with respect to the unit.

It will seldom, if ever, be necessary to change certain parameters once they have been entered and stored in NOVRAM 50. To prevent unauthorized tampering with these values, a key-operated switch 55 is provided. When switch 55 is in its normally open position, microprocessor 20 senses a high voltage on line 57, and as a result operates in a nonenabled mode in which it is impossible to change the values stored in NOVRAM 50 for certain parameters such as the beam and rolling constant. However, when switch 55 is closed, the resulting low voltage on line 57 causes the microprocessor to enter an enabled mode in which it prompts the operator to enter values for such parameters.

With the exception of gravity sensor 10, all of the functions shown in FIG. 1 may be implemented using conventional, general purpose components known to those skilled in the art. A suitable device for microprocessor 20 is the 6803 microprocessor available from Motorola.

Figure 2:
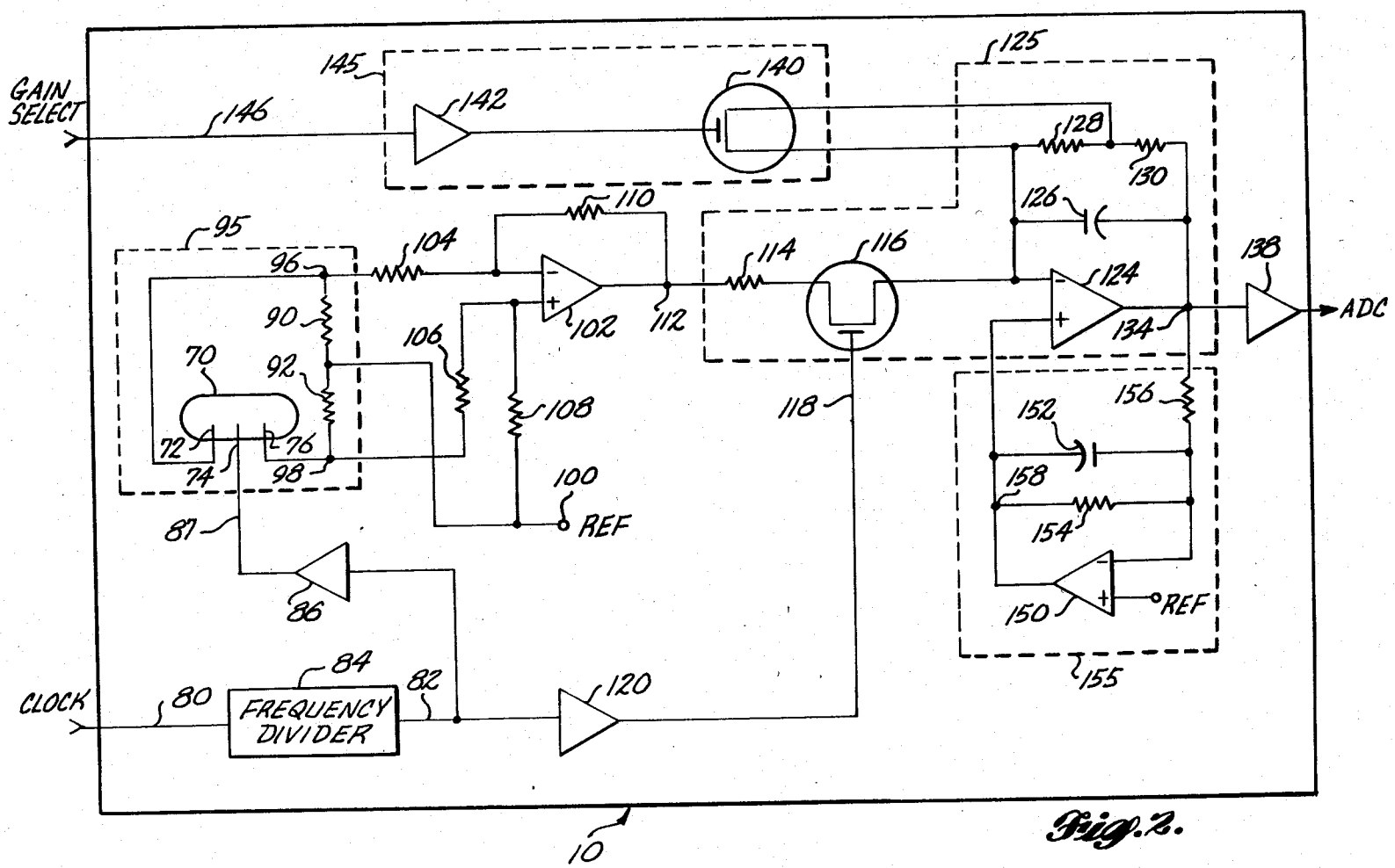
FIG. 2 is a circuit diagram of the gravity sensor of the present invention.

FIG. 2 illustrates the detailed construction of gravity sensor 10. The sesor includes a capacitative electrolytic transducer 70 that comprises a capsule partially filled with a viscous, dielectric fluid, and three metallic contacts 72, 74, and 76 that pass through the wall of the capsule. Transducer 70 is constructed such that when the transducer is level (horizontal) the capacitance $C_1$ between contacts 72 and 74 is equal to the capacitance $C_2$ between contacts 74 and 76. When the transducer is not level, either $C_1$ or $C_2$ will be greater, depending upon the direction of the tilt.

A high-frequency clock pulse signal 80 from microprocessor 20 is converted to a comparatively low-frequency (e.g., 1 kHz) signal 82 by frequency divider 84. Signal 82 is passed into a driver 86, and the driver output signal 87 is used to drive the central 74 of transducer 70. Resistors 90 and 92 form a bridge circuit 95 with capacitances $C_1$ and $C_2$ of transducer 70, with one end of bridge 95 driven by square wave signal 87, and the other end connected to a constant-voltage reference point 100, the reference voltage level designated by REF. Voltage level REF is selected to be approximately halfway between the level of the positive supply voltage and ground. The ouput nodes 96 and 98 of bridge 95 are connected, respectively, to the inverting and noninverting inputs of op-amp 102 through respective resistors 104 and 106. The noninverting input of op-amp 102 is also connected to reference voltage 100 through resistor 108. The inverting input of op-amp 102 is also connected to output node 112 via feedback resistor 110.

The purpose of op-amp 102 and its associated resistors is to provide an output signal at node 112 indicative of both the magnitude and direction of the tilt of transducer 70. In a preferred embodiment, resistors 90 and 92 are selected to have equal values, and resistors 104, 106, 108 and 110 are also selected to have equal values much greater than the value of resistors 90 and 92. As a result the voltages $V_1$ and $V_2$, at nodes 96 and 98 respectively of bridge circuit 95, are determined by the ratio of transducer capacitances $C_1$ and $C_2$. When the transducer is level, $V_1$ will equal $V_2$, and a DC signal of level $V_{REF}$ will appear at node 112. However, if $C_1$ differs from $C_2$, then the signal at node 112 will be a pulse train, of frequency equal to that of the driving signal 87, having an average value equal to $V_{REF}$ and an amplitude swing proportional to the difference between $C_1$ and $C_2$, e.g., proportional to the tilt angle. When $C_1$ exceeds $C_2$, corresponding to one direction of tilt, the signal at node 112 will be 180° out of phase with signal 87. When $C_2$ exceeds $C_1$, corresponding to the opposite direction of tilt, the signal at node 112 will be in phase with signal 87.

The signal at node 112 is passed through an active filter circuit 125 consisting of op-amp 124, analog switch 116, capacitor 126, and resistors 114, 128, and 130. The output of the filter circuit 125, at node 134, is then passed through buffer 138 to analog-to-digital converter 14 (FIG. 1). Associated with filter circuit 125 are a gain select circuit 145, consisting of analog switch 140 and buffer 142, and a level adjustment circuit 155, consisting of op-amp 150, capacitor 152, and resistors 154 and 156.

The gate signal 118 for analog switch 116 is obtained from frequency divider 84 through buffer 120. Switch 116 therefore allows the signal at node 112 to drive filter 125 only during the half cycle when the pulse signal 82 is positive. The result is that the signal input to filter 125 effectively has a level equal to $V_{REF}$ when transducer 70 is level, a level greater than $V_{REF}$ when transducer 70 is tilted in one direction, and a level less than $V_{REF}$ when transducer 70 is tilted in the opposite direction. The values of capacitor 126 and resistors 114, 128, and 130 are chosen such that filter 125 rejects all frequencies significantly higher than the frequency corresponding to the minimum expected rolling period, thus eliminating the high-frequency signal caused by the opening and closing of switch 116. Ignoring for the moment level adjustment circuit 155, the output of filter 125, at node 134, will be a slowly varying (e.g., 0.1 Hz) signal corresponding to the back-and-forth rolling motion of the vessel.

Filter circuit 125 is adapted to provide gain as well as filtering for the signal input at node 112. The amount of gain is determined by the ratio of resistors 128 and 130 to resistor 114. The amount of gain can be selected by means of analog switch 140. To decrease the gain, the microprocessor sends a high signal on gain select line 146. This signal passes through buffer 142 and into the gate of analog switch 140, closing the switch and shorting out resistor 128. A low signal on line 146 opens switch 140 and restores resistor 128 to the circuit, restoring the gain to its higher value. Suitable voltages for these resistors are:

R114—10 kilohms
R128—470 kilohms
R130—47 kilohms resulting in a gain that can be adjusted by a factor of 10.

The purpose of level adjustment curcuit 155 and gain select circuit 145 can be appreciated with reference to FIG. 3. The stability indicator of the present invention may at times be mounted in a vessel in a manner such that transducer 70 is offset several degrees with respect to the vessel horizontal. The result of such an offset is illustrated in FIG. 3*a*, in which curve 160 represents the output signal that would appear at node 134 if level adjustment circuit 155 was not present. Voltage level $V_+$ represents the maximum output that op-amp 124 can produce, i.e., the maximum value for signal 160. Voltage level $V_0$ corresponds to the offset inclination of transducer 70. $V_{REF}$ is the average voltage level that would be produced at node 134 if transducer 70 was level. In the case illustrated in FIG. 3*a*, the offset is such that transducer 70 is always inclined in one direction with respect to horizontal, even when the vessel has reached its maximum roll angle in the opposite direction.

It is generally desirable to increase the gain of filter 125 as much as possible, to increase the accuracy with which the microprocessor can measure roll angles. For example, if the output of ADC 14 (FIG. 1) is an eight-bit data word, then that data word will be capable of representing 256 unique voltage levels (0–255). If the signal of FIG. 3*a* were to be input to ADC 14, the resulting digital signal would vary only within a small portion of this range. It would therefore be desirable to increase the gain in filter 125 such that signal 160 occupied more of the range between the zero and $V_+$ voltage levels. FIG. 3*b* illustrates, however, that due to the offset voltage $V_0$, the gain cannot be significantly increased without driving signal 162 against voltage level $V_+$. The situation illustrated in FIG. 3*b* is unacceptable, since it results in a considerable loss of information and accuracy.

Figure 3A:
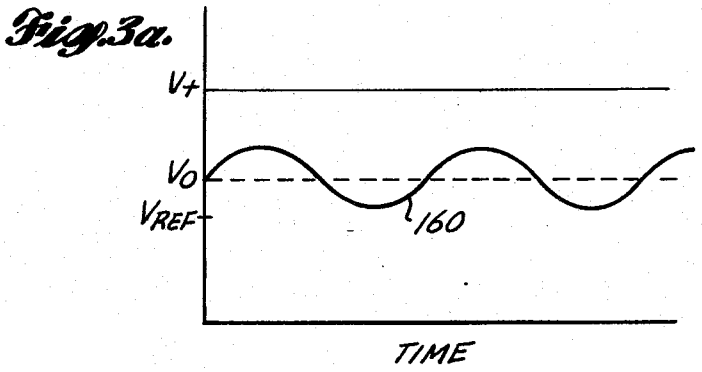
FIGS. 3*a*–3*d* are a series of graphs that illustrate the level adjustment and gain selection circuits of the present invention.
Figure 3B:
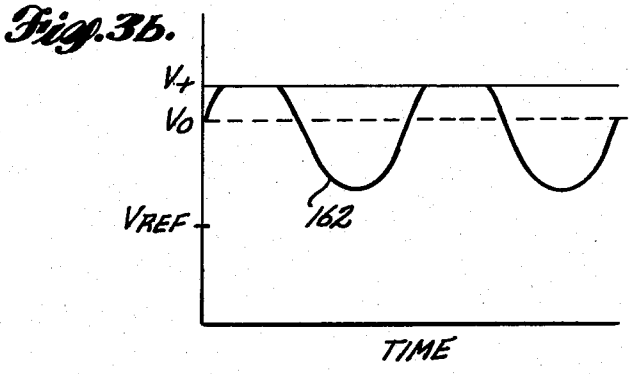
Figure 3C:
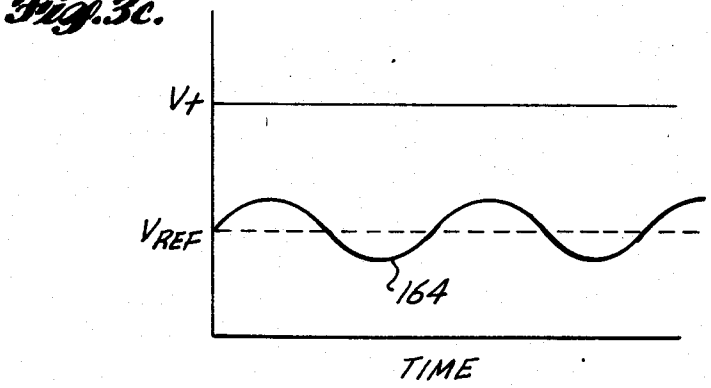
Figure 3D:
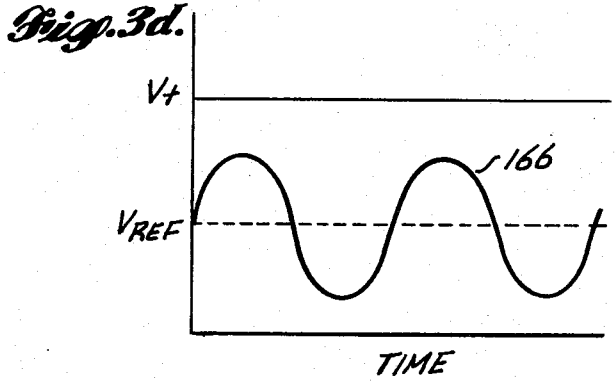
Figure 4:
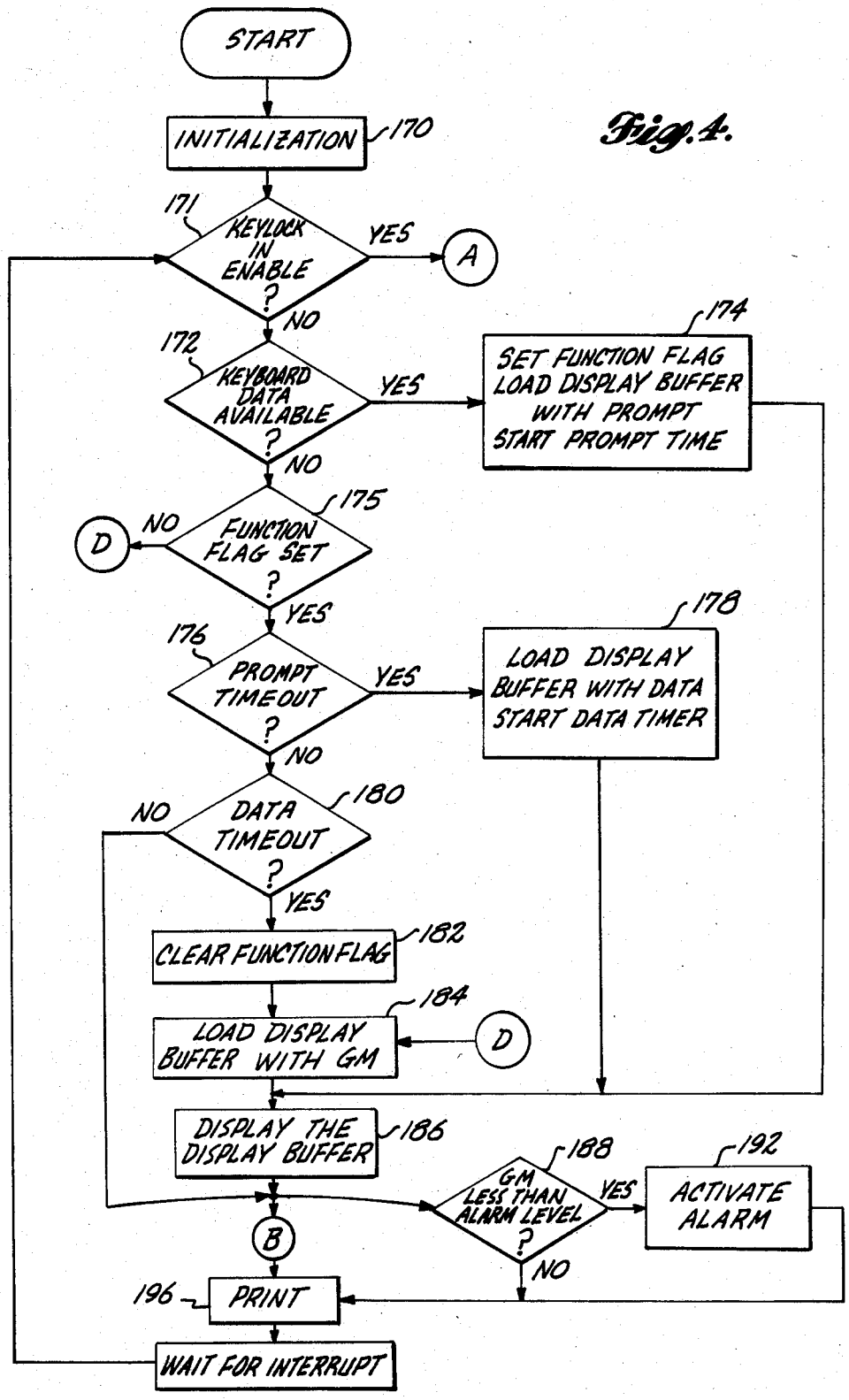
FIG. 4 is a flow diagram of a portion of a program for operating the microprocessor of the present invention.

Level adjustment circuit 155 is provided to overcome the problem indicated in FIGS. 3*a* and 3*b*. As shown in FIG. 3*c*, level adjustment circuit 155 operates on the signal appearing at node 134 to provide a signal 164 that has an average value equal to $V_{REF}$. Since $V_{REF}$ is selected to have a value approximately halfway between the zero and $V_+$ levels, the gain can now be increased, as indicated by signal 166 in FIG. 3*d*, without driving the signal against either the $V_+$ or zero levels. Level adjustment circuit 155 therefore provides the means for obtaining the maximum information content from the available signal. It should be understood that the purpose of FIG. 3 is to explain the gravity sensor operation, and the illustrated signals may or may not correspond to signals in an actual embodiment.

Level adjustment circuit 155 comprises a low pass filter consisting of op-amp 150, capacitor 152 and resistors 154 and 156. The values of capacitor 152 and resistor 154 are chosen such that frequencies corresponding the rolling motion of the vessel are rejected. Suitable values for these components are:

C152—100 microfarads
R154—2.2 megohms
R156—1.5 megohms

Since the noninverting input of op-amp 150 is held at voltage level $V_{REF}$, the output of filter circuit 155, at node 158, will be an essentially DC voltage equal to $$V_{REF}+G(V_{REF}-V_{134}) \quad (2)$$

where G is the gain determined by the ratio of resistors 154 and 156, and $V_{134}$ is the average voltage level at node 134 (averaged over several roll periods). Since the ouput voltage is fed back to the noninverting input of op-amp 124, the result will be that $V_{134}$ will tend to be equal to $V_{REF}$.

OPERATION

The operation of the stability indicator of FIG. 1 will now be described. In general, the stability indicator operates in either of two modes, depending upon whether switch 55 is open or closed. Switch 55 is part of a keylock mechanism (not shown), such that the switch can be opened and closed only by means of a key. When switch 55 is closed, the stability indicator enters a keylock enabled mode in which values for calibration parameters can be entered or modified. With switch 55 open, the stability indicator operates in a nonenabled mode in which calibration parameters cannot be modified. Unauthorized tampering with the calibration of the stability indicator can thereby be prevented.

The parameters that may be entered in enabled mode are the beam, the rolling constant, the alarm level, and the averaging constant. These values are entered through keyboard 40 and stored in nonvolatile random access memory 50. Thus once entered, these parameters are retained by the stability indicator, even if power is discontinued. The beam and rolling constant have been described above, and are calibration parameters that are generally obtained from the vessel's Stability Letter. Once entered, they will rarely, if ever, have to be modified. The alarm level parameter controls the sounding of alarm 60, and the averaging constant parameter determines how the displayed GM value is calculated. The stability indicator of the present invention calculates two average rolling periods, and two corresponding GM values. One GM value, termed the alarm GM, is calculated based on an average of 32 successive rolling periods. The second GM value, termed the display GM, is calculated based on an average of the number of rolling periods specified by the averaging constant. The display GM is the value displayed to the vessel operator via LCD unit 34. The alarm GM is used in conjunction with the alarm level for controlling alarm 60. In particular, alarm 60 is activated when the alarm GM falls below the alarm level. The alarm will remain activated until switch 55 is momentarily closed, even if the alarm GM thereafter rises above the alarm level. Typically, the stability indicator will be operated with an averaging constant greater than 32, for example, with an averaging constant of 200. This will produce a more stable and readable display on LCD unit 34. However, because alarm activation is based on a 32 period average, the stability indicator will remain capable of responding to rapid changes in vessel stability.

A program suitable for controlling the operation of microprocessor 20 is outlined in flow diagram form in FIGS. 4–7. Whenever power is turned on or the microprocessor is reset, program execution commences with the initialization step indicated by block 170 in FIG. 4. Program block 171 then checks the status of keylock switch 55 (FIG. 1). If the keylock is enabled (switch closed), the program jumps to block 200 in FIG. 5 and begins a calibration routine described below. If the keylock is not enabled, then program flow passes to block 172 in FIG. 4.

During normal operation of the stability indicator, data will not be available from the keyboard and no function flag (described below) will be set. Program flow will therefore be from block 171 through blocks 172 and 175 to block 184 where the display buffer is loaded with the current display GM value. Block 186 then sends the display GM value in the display buffer to LCD unit 34 (FIG. 1). The program then compares the current alarm GM with the alarm level in block 188. If the alarm GM value has dropped below the alarm level, then the alarm is activated in block 192. Block 196 then sends appropriate values to the printer, if one is provided. The program then waits in block 198 for an interrupt to occur.

The microprocessor of the present invention includes means for providing an interrupt signal whenever the contents of a free running counter register is equal to an interrupt control register. As described below, this feature is utilized to produce interrupt signals periodically, e.g., every 20 milliseconds, and these interrupts are used to provide the timing for the rolling period calculations. In particular, rolling periods and GM are calculated in an interrupt service routine which is called when this timed interrupt occurs, and the routine keeps track of time simply by keeping track of the number of times it has been called, each call corresponding to 20 milliseconds. The routine is described below and is set forth in FIGS. 6 and 7. Execution of the main progam steps shown in FIG. 4 usually requires less than 20 milliseconds, and the program therefore waits in block 198 for the next interrupt to occur. When it does, it calls the above-described routine, and upon return, jumps to block 171 to begin another loop.

The values of calibration parameters can be inspected, although not modified, when keylock 55 is not enabled. Keyboard 40 of the present invention preferably includes function keys corresponding to each of the parameters stored in NOVRAM 50, as well as numeric keys for entering particular values for the parameters. To inspect a given parameter, an operator presses the corresponding function key. Program block 172 detects the availability of the keyboard data, and passes control to block 174. Block 174 sets a function flag, and loads the display buffer with a prompt, corresponding to the function key pressed, and starts a prompt timer. For example, if the beam function key was pressed, the beam function flag would be set and the prompt "BEA" would be loaded. After performing the functions in block 174, program control passes to block 186, wherein the prompt is displayed. Program flow then continues as described previously. During subsequent passes through the FIG. 4 program, block 175 senses that a function flag is set and passes control to block 176. Block 176 checks to see whether the prompt has been displayed for a preselected time, the timing interval having commenced when block 174 was executed. When a prompt timeout is detected, block 176 passes control to block 178. Block 178 loads the display buffer with the value of the data (parameter) requested, and starts a data timer. During subsequent program loops, block 180 determines whether the data has been displayed for a preselected time, the timing interval having begun when block 178 was executed. When the preselected data time has elapsed, block 180 directs execution through blocks 182 and 184, wherein the function flag is cleared and the display GM value is once again loaded into the display buffer.

When the keylock of the present device is placed in an enabled position, then program control passes from block 171 to block 200 in FIG. 5. The keylock enabled routine of FIG. 5 allows the vessel operator to enter or revise values for parameters stored in NOVRAM 50, and also deactivates alarm 60. Thus if the alarm GM value ever falls below the preselected alarm level, alarm 60 remains activated until key operated switch 55 is closed. This feature is provided to ensure that alarms will not be ignored or go undetected.

When the keylock is enabled, the keylock enabled routine waits for the operator to specify the parameter, if any, to be changed. Until such parameter is specified, the execution path through the keylock enabled routine is from block 200 through blocks 202, 204, 222, 225 to block 227. Block 227 deactivates the alarm and the program then returns to block 196 in FIG. 4. When the operator does wish to enter or modify a parameter in enabled mode, he does so by pressing the corresponding function key on keyboard 40. Program block 202 detects the availability of the keyboard data, and passes control to block 206. Block 206 determines that a function key (as opposed to a numerical digit or ENTER key) has been entered, and passes control to block 212. Block 212 sets the appropriate function flag and a data entry flag, and loads the display buffer with the appropriate prompt. It then passes control to block 220, where the contents of the display buffer is displayed via LCD unit 34. During subsequent executions of the keylock enabled routine, block 204 directs program execution directly to block 227 until a numeric key is pressed.

When the operator begins to enter a new value for the requested parameter, block 202 senses the availability of keyboard data and passes control to block 210 through block 206. Block 210 detects that the data is a numerical digit (or decimal point), and passes control to block 216. Block 216 adds the digit to the display buffer and sets the data entry flag. Entry of digits continues during subsequent program loops until the ENTER key on keyboard 40 is hit, at which point block 210 passes control to block 218. Block 218 stores the entered parameter value in NOVRAM 50, writing over any value previously stored there. The display buffer is then reloaded with the prompt corresponding to the entered parameter, the prompt timer is begun, the verify flag is set, and the data entry flag is cleared. The program has now entered a verification mode in which the prompt and the newly entered data are sequentially displayed. During subsequent program loops, block 200 passes control directly to block 222, thus bypassing any keyboard data entered during verification. When verification is complete, block 225 passes control to block 226, at which point the verify and function flags are cleared, and the current value of display GM is loaded into the display buffer.

Figure 6:
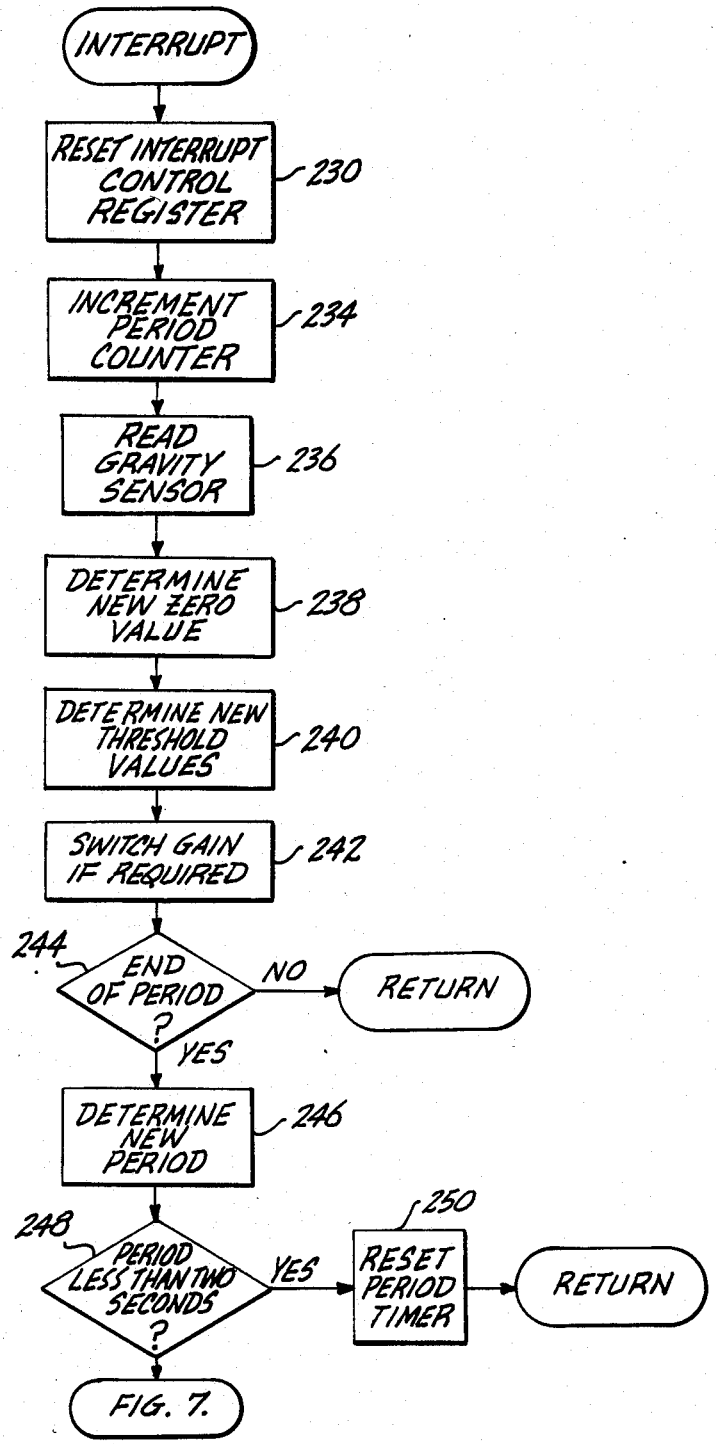
FIG. 6 is a flow diagram of a portion of a program for operating the microprocessor of the present invention.
Figure 7:
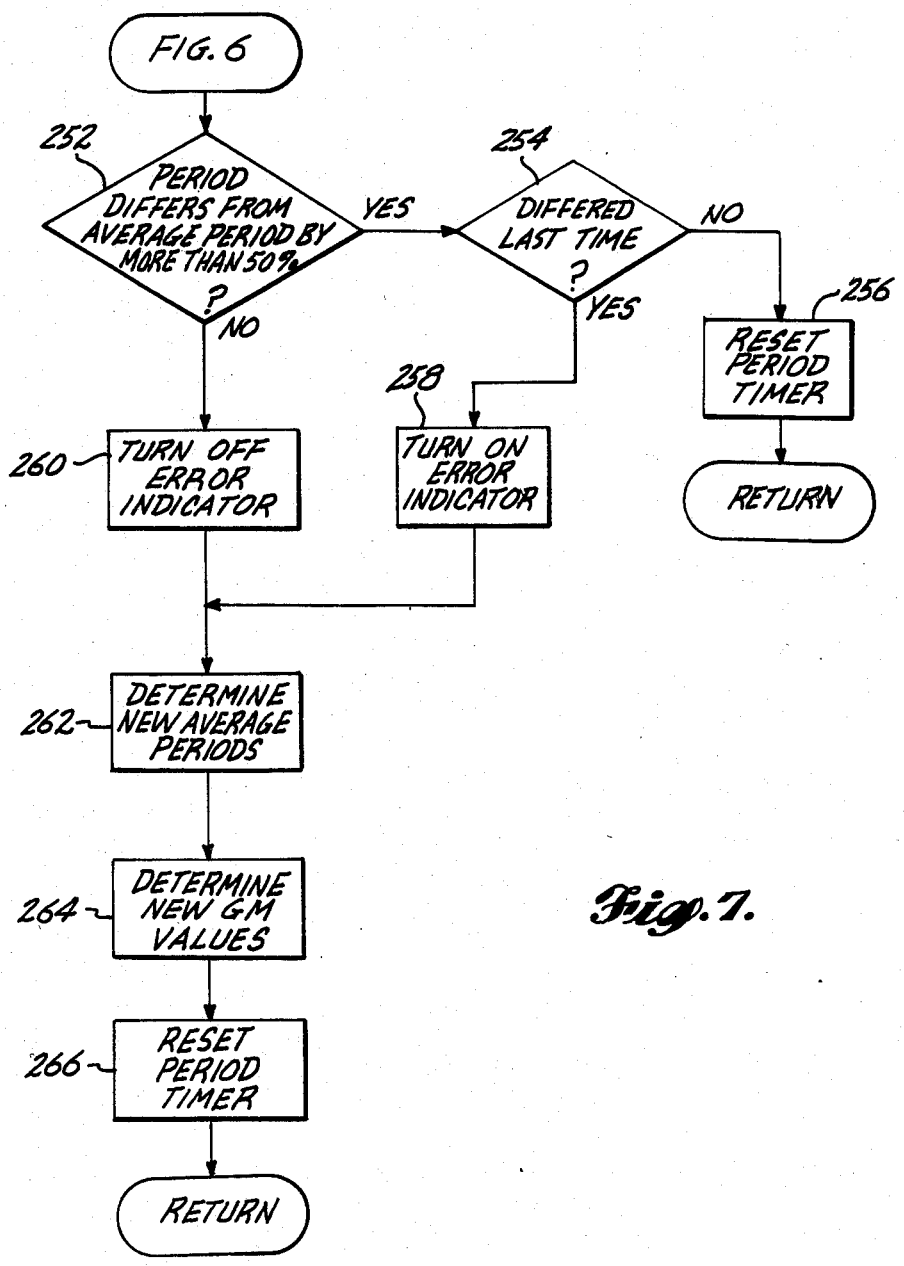
FIG. 7 is a flow diagram of a portion of a program for operating the microprocessor of the present invention.
Figure 8:
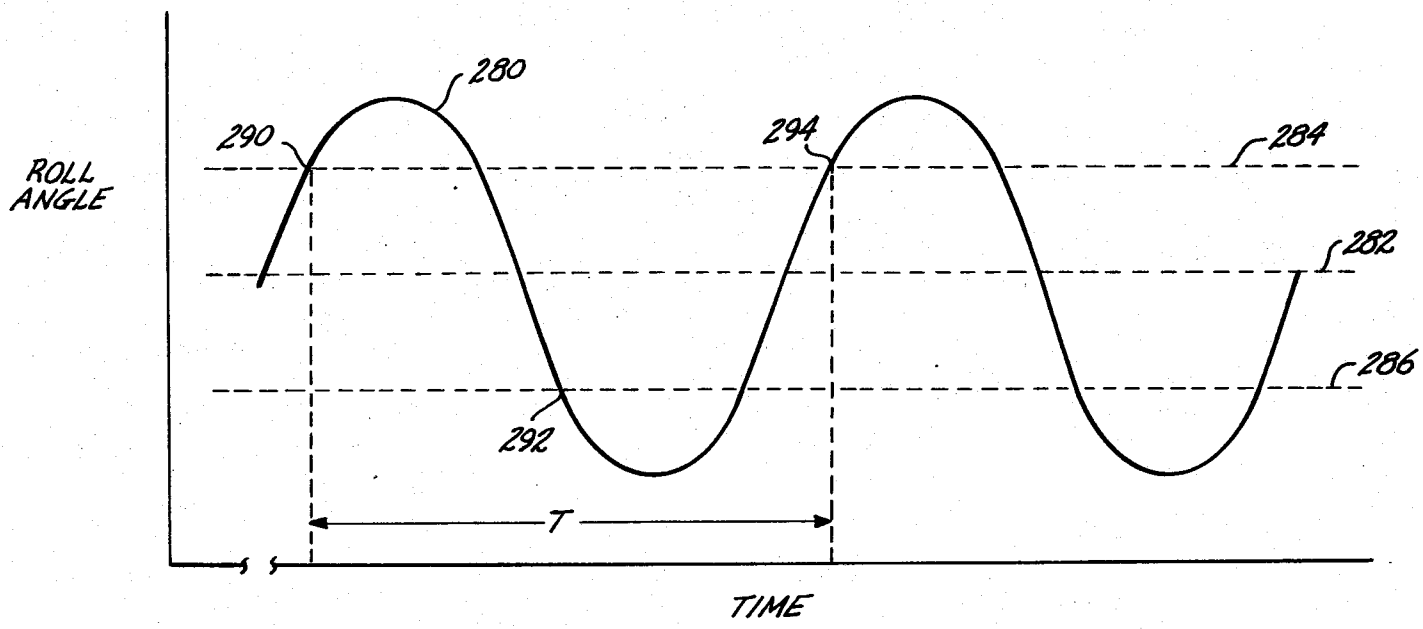
FIG. 8 is a graph illustrating the use of a zero level and threshold levels to determine roll periods according to the present invention.

The calculation of GM is performed by the interrupt service routine illustrated in FIGS. 6 and 7. As described above, this routine is called periodically (e.g., every twenty milliseconds) in response to an interrupt. The method by which the rolling period is calculated by this routine is illustrated in FIG. 8. In FIG. 8, line 280 represents the roll angle signal provided by sensor 10 and digitized by ADC 14. Although represented as a continuous curve for convenience, line 280 actually represents a series of sampled data points measured at twenty millisecond intervals along the time axis. To determine the rolling period for curve 280, a zero level 282 is first established by averaging curve 280 over four complete rolling cycles. The averaging is performed by a recursive filter of the form:

$$Z=(A-Z_1/K)+Z_1 \tag{3}$$

where A is the current sample of the roll angle signal, Z is the new zero level, $Z_1$ is the prior zero level value (i.e., the value of Z calculated during the prior execution of the subroutine) and K is the number of data points in four rolling periods, a rolling period for this purpose being the current value of the average rolling period used to calculate display GM. This filter therefore in effect averages successive values of A (i.e., curve 280) over four full rolling periods. One of the advantages of the filter represented by equation (3) is that the roll angle values for four rolling periods need not be stored by microprocessor 20.

Once the current zero level 282 is established, a threshold magnitude H is calculated by means of the formula:

$$H = \frac{\frac{|A-Z|}{2} - H_0}{K} + H_0 \tag{4}$$

where $H_o$ is the prior threshold magnitude and K has the same value as in equation (3). In effect, H is one half of the average absolute amplitude of curve 280 about zero level 282. In FIG. 8, line 284 represents the positive threshold level Z+H, and line 286 represents the negative threshold level Z−H.

Rolling period T is determined by finding the time required for curve 280 to go from a value greater than or equal to the positive threshold level 284 (e.g., point 290), through a value less than or equal to the negative threshold level 286 (point 292), and back to a value greater than or equal to positive threshold level 284 (point 294). In each case, the determination is based on the current value of threshold levels 284 and 286. Successive values for the rolling period T are filtered, using a filter of the form:

$$T_{AV} = \frac{T - T_{AV1}}{K_A} + T_{AV1} \tag{5}$$

where T is the current rolling period, $T_{AV1}$ is the previous average rolling period, and $T_{AV}$ is the new average rolling period. The constant $K_A$ represents the number of periods over which the average is to be taken. Two different $K_A$ values are used to produce the two different average rolling periods and GM values described above. $K_A$ is set to 32 to calculate alarm GM, and is set to the user supplied averaging constant to calculate display GM.

The above-described filters are initialized (block 170, FIG. 4) by setting $T_{AV}$ for both display and alarm GM equal to two seconds. This $T_{AV}$ for display GM then determines the K value for equations (3) and (4), permitting calculation of zero and threshold levels as roll angles are measured. Any reasonable initial values may be used for the zero and threshold levels. When the first rolling period T is determined, $T_{AV}$ for display and alarm are set to T, and $K_A$ is set to four. After eight rolling periods have been measured, the $K_A$ values described above are used.

Turning now to FIG. 6, the subroutine for performing the operations outlined in FIG. 8 begins by resetting the interrupt control register in block 230, and by incrementing the period counter in block 234. The interrupt control register is reset by reading the value of that register, adding a number corresponding to 20 milliseconds, and placing the result back in the interrupt control register. Interrupts are automatically generated whenever a free running counter register is equal to the interrupt control register. The counter register is automatically incremented by one at a high (e.g., 1 MHz) rate. Thus, the result of the operation of block 230 will be to generate an interrupt after another 20 milliseconds have elapsed.

The period counter is used to determine the number of 20 millisecond intervals in each rolling period, and is reset to zero (as described below) each time a rolling period has been determined and measurement of a new rolling period is to begin. Block 236 reads the current roll angle value supplied from gravity sensor 10 through ADC 14. Blocks 238 and 240 then determine new zero and threshold levels, as per equations (3) and (4) above. Block 242 then determines whether the gain of gravity sensor 10 should be modified. The gain is determined by the gain select signal sent by microprocessor 20 to gain select circuit 145 of gravity sensor 10 (FIG. 2). In one preferred embodiment of the present invention, the roll angle values provided by ADC 14 are represented by an 8-bit data word capable of representing 256 unique values. In this embodiment, block 242 switches the gain from low to high if the difference between zero level 282 and positive threshold 284 becomes two or less, and switches the gain from high to low if such difference becomes 40 or more.

Block 244 determines whether the end of the currently measured period has been reached, e.g., has the roll angle signal reached point 294 in FIG. 8. If it has not, a return is taken to the main program. If an end of period is detected, then block 246 determines the length of the new period T and block 248 checks to see if T is less than two seconds. If so, the measurement is assumed to be erroneous, the period counter is reset in block 250, and control returns to the main program. If T is not less than two seconds, block 252 (FIG. 7) then checks to see whether it differs from the current average period by more than 50%. If so, block 254 tests to see whether this is the second time in a row that a period differed from the average by more than 50 percent. If it is not the second time in a row, the period timer is reset in block 256 and the program returns. If this is the second time in a row that the period differed from the average by more than 50 percent, block 258 turns on error indicator light 61 (FIG. 1), warning the vessel operator that erratic readings are being obtained. The error indicator is turned off by block 260 when the test in block 252 is not satisfied.

Block 262 uses the newly measured period T to determine new average periods, using the filter set forth in equation (5) above. The new average periods are then used to calculate new values for display GM and alarm GM in block 264, at which point the period timer is reset in block 266 and the program returns.

The stability indicator of the present invention may include means adapted for determining GM during loading of a vessel, i.e., when the vessel is not continually rolling. Such means includes means for indicating from the keyboard that the instrument is to be operated in such a "load" mode as opposed to the normal "sea" mode, and means responsive to such indication for setting $K_A$ (equation (5)) for both display and alarm GM calculations equal to one. By placing the stability indicator in load mode, a captain can therefore estimate a ship's GM value as the vessel rolls in response to individual items of cargo being loaded.

It will be understood that the invention may be embodied in other specific forms without departing from the central characteristics thereof. The present examples and embodiments are therefore to be considered in all respects as illustrative and not restrictive, and the invention is not to be limited to the details given herein, but may be modified within the scope of the following claims.

The embodiments of the invention in which an exclusive property or privilege is claimed are defined as follows:

1. A stability indicator for a marine vessel, comprising:

sensor means for producing a first signal having a continuously variable characteristic, such as voltage magnitude, that continuously varies in a predetermined manner as the roll angle of the vessel continuously varies, such that the instantaneous value of the roll angle may be determined by measuring the instantaneous value of said characteristic; and processing means including means for receiving said first signal and for repeatedly measuring said characteristic over a period of time to thereby determine a plurality of instantaneous roll angle values over the period of time, means for determining the vessel's rolling period based on said plurality of roll angle values, and means for determining a GM value equal to the square of the vessel's beam length times the square of the vessel's rolling constant divided by the square of the vessel's rolling period.

2. The stability indicator of claim 1, wherein the processing means further comprising means for storing values corresponding to the beam length and to the rolling constant.

3. The stability indicator of claim 1, wherein the sensor means comprises sensing circuit means for producing a second signal corresponding to the magnitude and direction of the instantaneous roll angle of the vessel, and amplifier means for producing said first signal by applying a selectable amount of gain to said second signal.

4. The stability indicator of claim 3, wherein the processing means includes means for providing a gain select signal, and wherein the amplifier means is responsive to the gain select signal to select the amount of gain applied to the second signal.

5. The stability indicator of claim 3, wherein the sensing circuit means comprises a capacitive gravity sensor, and wherein the amplifier means comprises a demodulator for demodulating the second signal.

6. The stability indicator of claim 4, wherein the processing means further comprises means for sampling the first signal, means for determining a zero level corresponding to the average value of the sampled first signal, means for determining first and second threshold levels spaced apart from the zero level on opposite sides thereof, the magnitude of the difference between the first threshold level and the zero level being a predetermined function of the average absolute difference between the sampled first signal and the zero level, means for determining the vessel's rolling period by determining the length of a time interval that begins when the sampled signal changes from a value on one side of the first threshold level to a value on the opposite side of the first threshold level and that ends at the next subsequent time at which the sampled signal changes from a value on said one side of the first threshold level to a value on said opposite side of the first threshold level, provided that the sampled signal crossed the second threshold level during said time interval, and means for providing the gain select signal based upon the difference between the zero level and the first threshold level.

7. The stability indicator of claim 1, wherein the sensor means comprises level adjustment means for adjusting the average level of the first signal such that said average level is approximately equal to a fixed reference level.

8. The stability indicator of claim 1, wherein the processing means comprises means for sampling the first signal, means for determining a zero level corresponding to the average value of the sampled first signal, means for determining first and second threshold levels respectively above and below the zero level, and means for determining the vessel's rolling period by determining the time required for said sampled signal to change from a value exceeding the first threshold level to a value less than the second threshold level and back to a value exceeding the first threshold level.

9. The stability indicator of claim 8, wherein the first and second threshold levels are respectively greater than and less than the zero level by an amount equal to a predetermined fraction greater than zero and less than one of the average absolute difference between said sampled signal and the zero level.

10. The stability indicator of claim 1, wherein the processing means includes means for determining an average rolling period by averaging successive rolling periods, and means for determining a GM value equal to the square of the vessel's beam length times the square of the vessel's rolling constant divided by the square of said average rolling period.

11. The stability indicator of claim 1, further comprising an alarm connected to the processing means for providing a warning when the GM value is less than an alarm level.

12. The stability indicator of claim 1, wherein the processing means includes means for determining first and second average rolling periods and corresponding first and second GM values based thereon, the first average rolling period being determined by averaging a fixed number of successive rolling periods, and the second average rolling period being determined by averaging a selectable number of successive rolling periods, and wherein the stability indicator further comprises display means for displaying said second GM value and alarm means connected to the processing means for providing a warning when the first GM value is less than an alarm level.

13. A stability indicator for a marine vessel, comprising:

sensor means for producing a signal corresponding to the instantaneous value of the roll angle of the vessel, the sensor means including level adjustment means for adjusting the average level of said signal such that said average level is approximately equal to a fixed reference level; and processing means responsive to said signal for determining the vessel's rolling period and a GM value based on the rolling period.

14. A stability indicator for a marine vessel, comprising:

sensor means for producing a signal corresponding to the value of the instantaneous roll angle of the vessel;

processing means responsive to said signal for determining the vessel's rolling period and a GM value based on the rolling period, the processing means including means for sampling said signal, means for determining a zero level corresponding to the average value of the sampled signal, means for determining first and second threshold levels spaced apart from the zero level on opposite sides thereof, the magnitude of the difference between the first threshold level and the zero level being a predetermined function of the average absolute difference between the sampled first signal and the zero level, and means for determining the vessel's rolling period by determining the length of a time interval that begins when the sampled signal changes from a value on one side of the first threshold level to a value on the opposite side of the first threshold level and that ends at the next subsequent time at which the sampled signal changes from a value on said one side of the first threshold level to a value on said opposite side of the first threshold level, provided that the sampled signal crossed the second threshold level during said time interval.

15. The stability indicator of claim 14, wherein the first and second threshold levels are each spaced from the zero level by an amount equal to a predetermining fraction greater than zero and less than one of the average absolute difference between said sampled signal and the zero level.

* * * * *